United States Patent [19]

Mayfield et al.

[11] 4,142,371

[45] Mar. 6, 1979

[54] REMOVABLE CLOSURE APPARATUS FOR HOLLOW COLUMNAR MEMBERS

[75] Inventors: Windel O. Mayfield, Corsicana; John M. Montague, Dallas; Clarence T. Thomerson, Corsicana, all of Tex.

[73] Assignee: Regal Tool & Rubber Co., Inc., Corsicana, Tex.

[21] Appl. No.: 822,401

[22] Filed: Aug. 8, 1977

[51] Int. Cl.[2] ..... E02B 17/04

[52] U.S. Cl. ..... 405/224; 405/227; 138/89; 277/237 R

[58] Field of Search ..... 61/87, 88, 89, 94, 96, 61/98, 99, 69 R, 82; 277/187, 237; 285/18, 21; 206/616; 114/296, 297, 300; 138/89

[56] References Cited

U.S. PATENT DOCUMENTS 2,760,714 8/1956 Rasmussen ..... 206/616

3,680,689 8/1972 Grundschober ..... 206/616 X

*Primary Examiner*—Jacob Shapiro

*Attorney, Agent, or Firm*—Richards, Harris & Medlock

[57] ABSTRACT

A removable closure apparatus for tubular members of offshore platforms and the like utilizes a body inserted in the tubular member. A seal formed in an annulus between the inner surface of the tubular member and the outer surface of the body is bonded to each of the surfaces of the body and the tubular member. The seal is broken by use of a flexible tensile bearing inlay spirally embedded within the seal. The inlay is torn from the seal to destroy the structural integrity thereof and permit removal of the body. The inlay has one end affixed to the body and a second end extending upwardly through the member for manipulation from the upper end thereof. A force applied to the second end of the inlay causes it to tear the seal along a spiral path.

6 Claims, 5 Drawing Figures

REMOVABLE CLOSURE APPARATUS FOR HOLLOW COLUMNAR MEMBERS

BACKGROUND OF THE INVENTION

This invention relates to removable closure apparatus for hollow columnar members. More particularly, the invention relates to removable bottom closure apparatus for open-ended tubular piles, pile guides and jacket columns and conductor pipes used in offshore platform structures.

In the initial stages of some offshore platform installations, the structure is required to be buoyant in order to permit controlled launching and erecting of the platform into position for placement on the ocean floor. Typically, buoyancy has been provided by closing the ends of jacket legs that form the support for the platform and through which piles are to be driven. Alternatively, buoyancy for the platform structure can be provided by outfitting the structure with shirt sleeves which are closed at the ends. A further alternative is to insert tubular piles within the jacket legs or within pile guides and close the ends. In any of the foregoing approaches to providing an offshore structure with buoyancy, it has been conventional practice in the art to close the ends of a jacket column, pile guide or open-ended pile with some type of an end closure.

As a platform is erected to assume the proper upright position for permanent installation on the ocean floor, the buoyancy provided by the closures is varied by selectively flooding closed chambers. It thus becomes necessary to remove the closures in order to permit the driving of pilings into the ocean floor to secure the structure in place or for insertion of drill pipe in conductor pipes.

One approach in the prior art includes a platform structure with buoyancy by welding a closure plate in the lower end of a jacket column. Removal of the closure plate is by driving a pile against the closure plate with sufficient force to rupture weld that holds a closure plate in position. This solution, however, has not been found to be satisfactory. Often times a portion of the weld or closure plate will remain attached to the inside surface of the jacket column presenting a restriction to the driving of the pile. Also, closure plates removed in this manner has been found to be susceptible to wedging within the jacket column, making it further difficult to drive a pile through the column.

Another approach to the problem of providing an effective removable lower closure member for a jacket column on an offshore platform is disclosed in U.S. Pat. No. 3,613,381. A lower closure member is welded at its periphery to the wall of the jacket column. It is removable through the upper end of the jacket column by breaking the weld away from the surrounding wall and pulled the fragments upwardly through the jacket column on the end of a pull line. The closure member is in the form of a truncated cone welded at its periphery to the wall of the jacket column. A tearing arm is rigidly secured to the closure member near its periphery and extending upwardly to a point above the closure member. The arm is connected to a pull line extending through the column to the upper end thereof. A length of heavy chain extends around the periphery of the closure member on its lower side and is welded at spaced points to the closure member with one end of the chain being secured to the arm. The chain forms a tear strip which, upon the application of an upward strain of adequate magnitude to the pull line, tears the weld that holds the closure member to the wall of the jacket column.

A residual rim of steel or weld metal is left on the inner surface of the jacket and can present a substantial restriction to the driving of a pile therethrough.

The prior art also includes a removable closure for the lower end of a jacket column disclosed in U.S. Pat. No. 3,577,737. A watertight plug assembly utilizes a compressible rubber member for engaging the inner surface of the wall of the jacket column to seal off the lower end of the column. In combination with the rubber member, the plug assembly includes a mechanism for applying pressure to the top and bottom sides of the rubber member causing it to expand laterally and engage the inner surface of the jacket column wall. To remove the plug assembly, the pressure applied to the top and bottom of the rubber member is relieved allowing the rubber member to resume its original shape and to disengage the jacket column wall. This closure, however, has the obvious disadvantage of requiring mechanical locking devices and moving parts that can malfunction.

The prior art also includes a removable closure using a rupturable diaphragm of reinforced elastic material and is removable in the sense that the elastic diaphragm can be ruptured by driving a pile therethrough.

SUMMARY OF THE INVENTION

The present invention is directed to a closure for open-ended hollow columnar members that is removable. A tubular member suitable for attachment to a cylinder that is to be closed by an impervious body positioned intermediate the ends thereof. A seal is formed between the inner surface of the tubular member and the outer surface of the body by bonding a fracturable cylinder to each of the surfaces. A mechanism for progressively and circumferentially destroying the structural integrity of the seal is provided to permit removal of the body from the tubular member. The seal includes a tensile bearing flexible inlay spiraled around the body and embedded within the seal. The inlay has a first end affixed to the body and a second end extending upwardly through the tubular member for manipulation from the upper end. By pulling on the second end of the inlay, the seal is destroyed by tearing the inlay out of the seal along a spiral course. Further withdrawal of the cable after the seal is ruptured effects removal of the body.

In one aspect of the invention, the body comprises a dome having a cylindrical skirt to which the seal adheres having a diameter that permits it to be inserted into the interior of the tubular member.

BRIEF DESCRIPTION OF THE DRAWING

A more complete understanding of the invention may be had by reference to the Detailed Description of a particular embodiment which is presented below and illustrated in the accompanying drawing in which.

DETAILED DESCRIPTION OF A PREFERRED EMBODIMENT

Figure 1:
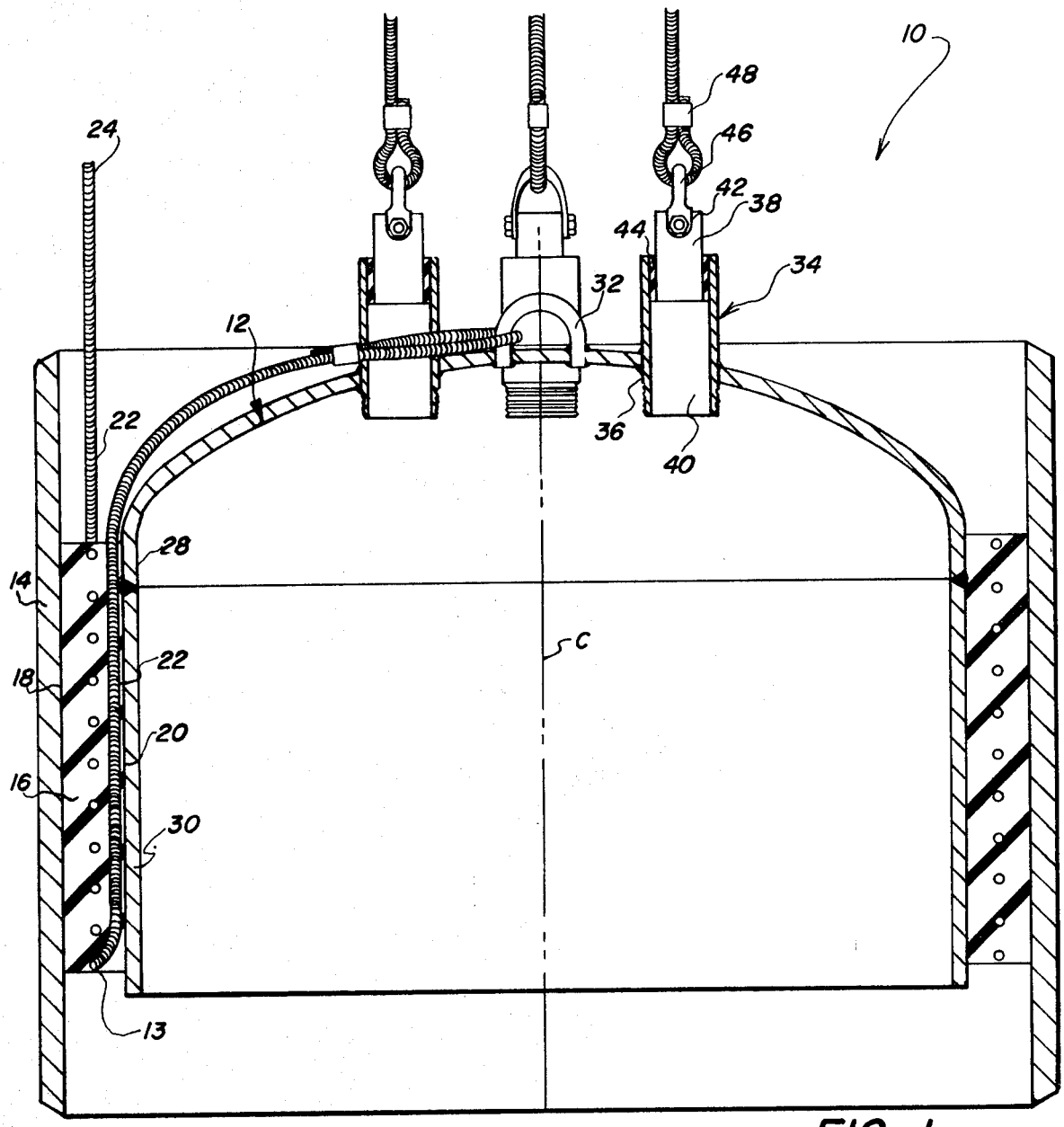
FIG. 1 is a cross-section of a removable closure in accordance with the present invention for open-ended hollow columnar members.

The removable closure apparatus illustrated in FIG. 1 is of the type adapted to be installed in tubular members such as jacket legs, pile guides or skirt sleeves as parts of offshore platforms.

The closure apparatus shown in FIG. 1 includes a hollow domed plug 12. Plug 12 forms an impervious body which when inserted into tubular member 14 positioned concentrically occupies most of the area of the member 14 and defines a uniform annulus 13. A seal 16 is formed around plug 12 between the inner surface 18 of tubular member 14 and the outer surface 20 of plug 12. In the embodiment shown seal 16 is formed by bonding a rubber ring to surfaces 18, 20. A cable 22 is provided for destroying the structural integrity of seal 16 to permit removal of plug 12 from within tubular member 14.

Seal 16 has an embedded cable that is spiraled several times around plug 12. Destruction of the integrity of seal 16 by cable 22 results by pulling on end 24 of cable 22. Upon the application of a sufficient force, cable 22 is ripped from seal and unspirals from seal 16. This results in the tearing of seal 16 in multilevel spiral paths. End 26 of cable 22 is affixed to the top of plug 12 in order that cable 22 can be utilized to remove plug 12 from within tubular member 14 after seal 16 is destroyed.

In the specific embodiment shown in FIG. 1, plug 12 comprises a dome-shaped head 28 that is welded to a section of pipe 30 forming a cylindrical skirt of a smaller diameter than the inside diameter of pipe 14. An eyelet 32 is welded to the top of head 28 in alignment with the center line "C" of plug means 12.

Apparatus 10 is adpated for use in tubular members in marine structures such as offshore platforms. Tubular member 14 may be a tubular pipe section of the same size and shape as the platform leg installed as by welding to form a permanent section of the leg at an appropriate point along the length of the leg. So utilized, removable closure apparatus 10 provides an effective means to close off an end of the leg to provide buoyancy during initial phases of platform installation. The plug can then be completely removable so as to not present restrictions at the plug site.

In FIG. 1, it is to be appreciated that cable 22 is not shown in its complete length in FIG. 1. It is contemplated that cable 22 will extend upwardly through an open-ended tubular member for manipulation at the upper end thereof. Cable 22 is pulled upwardly until it has completely unspiraled from around plug means 12. Thereafter cable 22 may pull on plug 12 to destroy any remaining bonding to seal 16. Plug 12 is then removed.

Before removing plug 12, it is advantageous in some applications to first equalize pressures across plug 12. In such case, plug 12 may be provided with at least one pressure equalization means 34 provided to permit entry of fluid, such as water, into the portion of the columnar member above the closure apparatus through plug 12.

For the particular embodiment shown in FIG. 1, suitable provision for pressure equalization is shown in FIG. 1 to include a portion 36 in plug 12 having a pull-out stopper 38 inserted therein. Port 36 comprises a small diameter pipe section 40, and stopper 38 comprises a rod 42 held inside the pipe section wall by a bonded rubber compound seal 44. One end of stopper 38 protrudes out of pipe section 40 and has a loop 46 to which a cable 48 is attached.

As will be understood, pressure on each side of plug 12 is equalized by removal of stopper 38 from port 36, allowing the portion of the tubular pile above closure apparatus 10 to be flooded. Once pressure is equalized, removal of plug 12 in the aforementioned manner can proceed.

A number of small pressure equalization means may be used. For example, as shown in FIG. 1, four pressure equalization means of the type described are positioned symmetricaly about the center line "C" of plug 12, with all four plugs being pulled by a common cable and/or bridle arrangement.

Apparatus in accordance with the present invention, can be utilized with open-ended tubular members of any size, a typical installation may be in open-ended tubular members constructed of 48" O.D. pipe. Plug 12 may have a 40" O.D. and 31" length. The seal 16 formed between the surfaces of the plug 12 and the tubular member would be approximately 3" thick, with a height of 13". A $\frac{5}{8}$" wire cable could be embedded in the seal and spiraled around the plug 12 approximately ten times. The seal material may be polyisoprene but there are several different materials that may be employed as will be described. The material must be of such character and the body thereof dimensioned to withstand the hydrostatic forces involved and yet be amendable to destruction by the tearing action of the cable.

Tests on removable closure members of the above dimensions have shown that the closure can withstand pressures of 250 psig with no leakage, and that the maximum force required for removal of the looped cable from the rubber compound seal is 6700 lbs., a pulling force of 16,000 lbs. having been required for removal of the plug.

Figure 2:
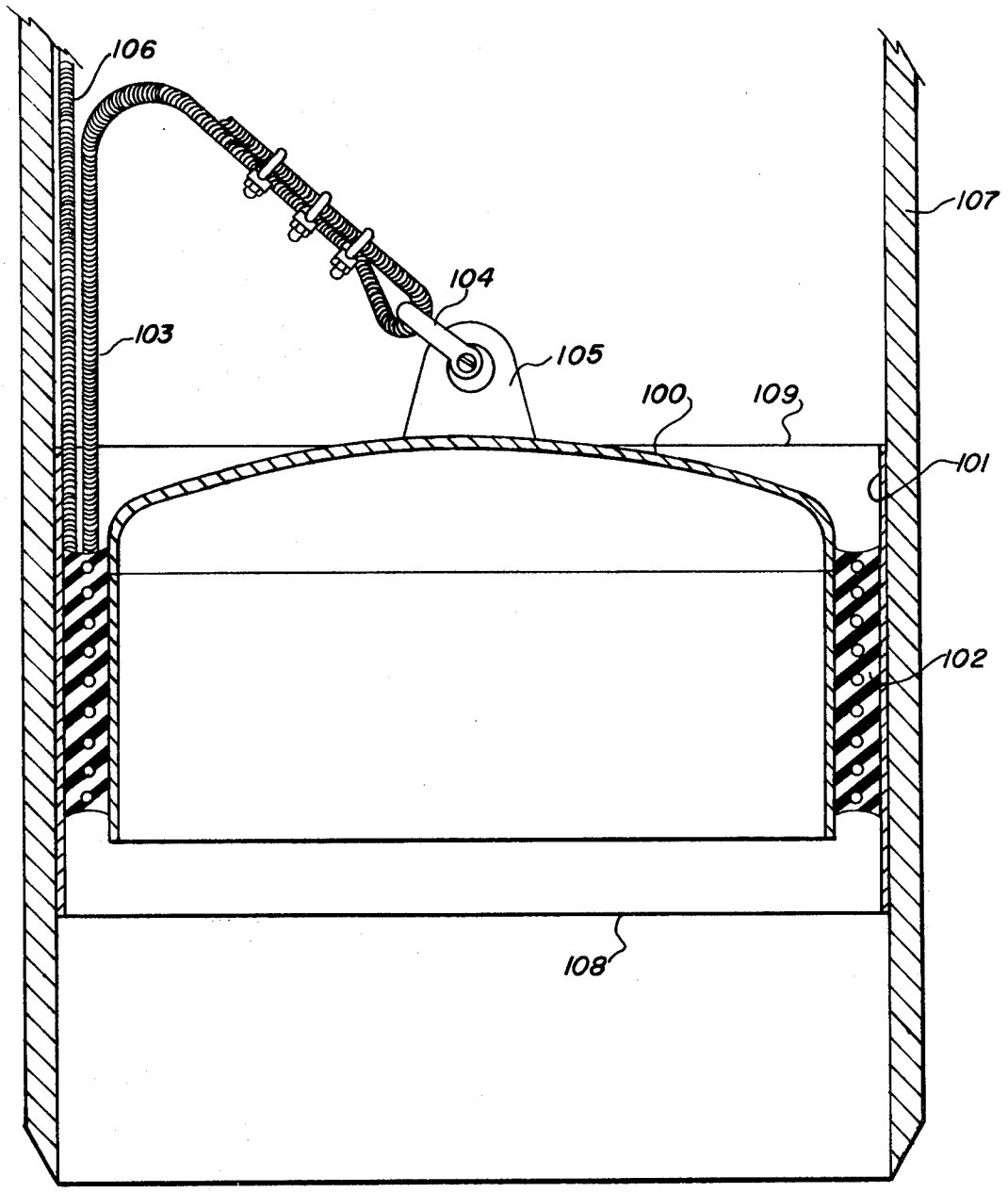
FIG. 2 illustrates a modification in which a closure system is self-contained.

FIG. 2 illustrates a further embodiment of the invention in which the domed element 100 is secured inside a relatively short thin walled cylinder 101. As in FIG. 1, a rupturable seal 102 is bonded to the outer surface of the dome 100 and the inner surface of cylinder 101. Further, as in FIG. 1, the seal 102 includes a plurality of turn of a flexible tensile bearing inlay which in the form shown in FIG. 1 and 2 is a cable 103. The end of the cable 103 is fastened by way of a link 104 to an eyelet 105 secured to the top of the dome 100. The other end 106 of cable 103 extends upward to the surface so that tension may be applied to the end 106, thereby progressively and circumferentially tearing the seal 102 to release the dome 100 from the outer member 107. It will be noted that the thin walled cylinder 101 is secured to the inner wall of the member 107 as by welds 108 and 109.

It will be understood that the seal 102 may be made from any number of different materials. Rubber has been mentioned in connection with the description of FIG. 1. The member 102 may be made with polyurethane or may be made of a frangible epoxy or may be made of metal such as aluminum. If made of alminum, a short relatively thick walled cylinder would be molded with the cable spiraled therein. The aluminum cylinder would then be secured to the outer wall of dome 100 and to the inner wall of cylinder 101 by suitable epoxy cement or by any other suitable means. In any event, any material which would withstand the shear forces imposed onto the dome 100 for the particular installation involved would be satisfactory so long as it would have low resistance to tearing forces. Generally, it would be understood that an annular seal of rupturable material would secure a body member such as the dome 100 to the inner wall of the tubular member such as the mounting cylinder 101 or even to the inner walls of the member 107. The annular seal would include at least substantially one complete turn of a flexible tensile bearing inlay which would be provided or established for applying tension to the inlay for the progressive and circumferential tearing of the seal to release the body from the member in which it is secured by the seal. In that connection, it will be recognized that while cable 103 has been illustrated for the purpose of simplicity in the present application, the tensile bearing inlay may be of chain or may be a steel tape or may be rope of suitable material or may be made in spring form from a solid metal rod.

Figure 3:
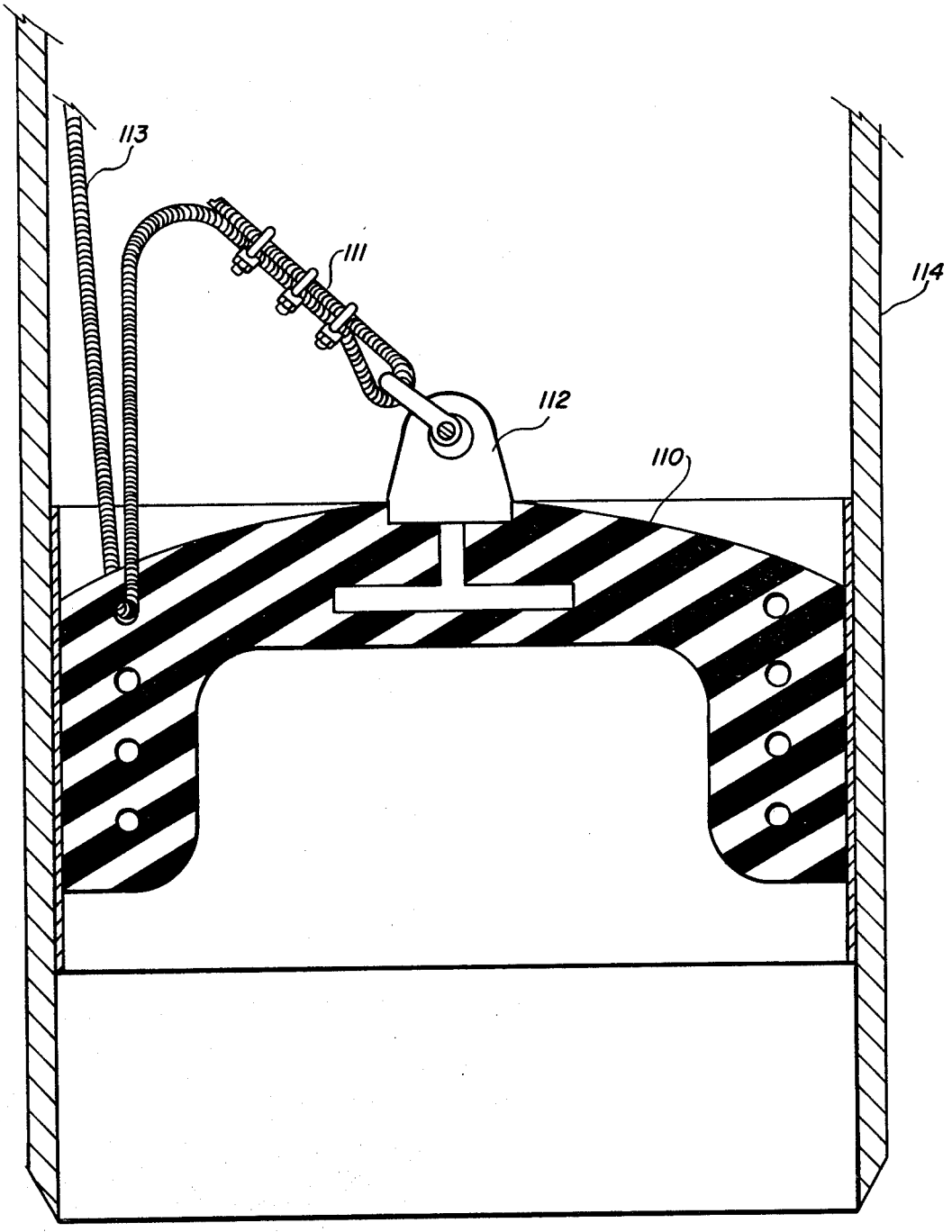
FIG. 3 illustrates a resilient body forming the closure.

Further, the dome 100 forms an impervious body which occupies a major portion of the cross sectional area of the member 107 and is secured therein by the rupturable seal. It will be appreciated that the impervious body need not be in the form of the dome shown in FIGS. 1 and 2. Rather, as shown in FIG. 3, the body 110 may be all of the same material as the seal itself. As shown in FIG. 3, a relatively thick membrane of rubber or polyurethane or similar material is provided to be relatively dome-shaped with the cable 111 secured to a eyelet 112 and the other end of the cable 113 spiraled in the body of the closure member 110. The spiral inlay is in the zone immediately adjacent to the inner walls of the tubular member 114 in which it is mounted.

Thus, the body may be of metal and dome-shaped or other suitable shape depending upon the forces to be resisted. It may be made of polyurethane or may be made of nylon reinforced with rubber or other materials depending upon the installation involved.

Figure 4:
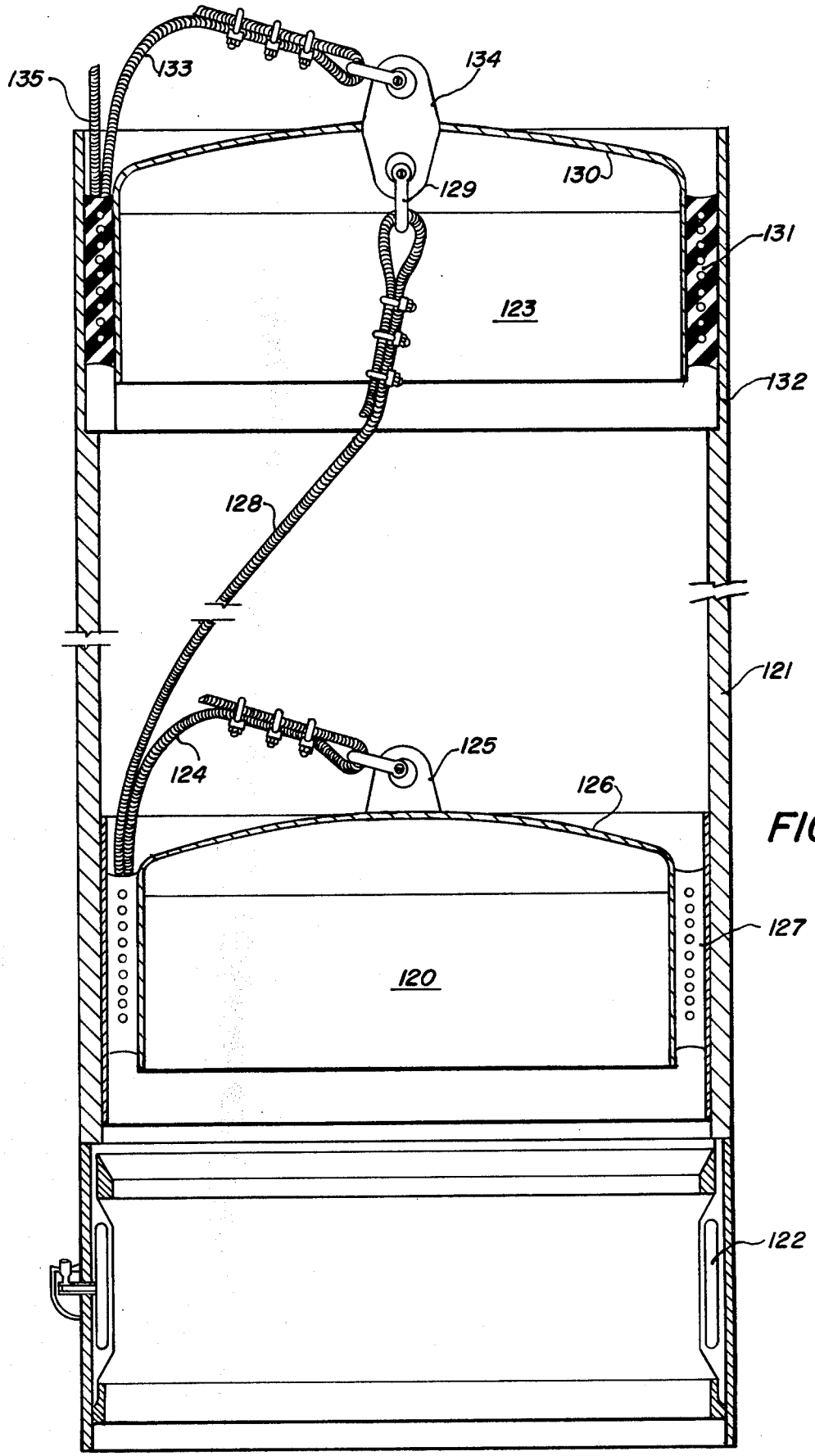
FIG. 4 illustrates a dual closure installation.

FIG. 4 illustrates a further application of the invention. In this embodiment, a lower closure 120 is secured inside and at the lower end of a skirt sleeve 121. Skirt sleeve 121 will be understood to be an elongated cylinder through which a piling would be driven to secure a platform or similar structure at a given location in a marine area. In this embodiment, the lower end of the sleeve is provided with a packer structure 122, the packer structure involving an inflatable, toroidal, resilient member so that after removal of the closure 120 and its companion closure a piling may be driven through the skirt sleeve. The packer 122 is then to be actuated to seal the annulus for introduction of grout to adhere the piling to the skirt sleeve 121. However, before any such piling is introduced, the closure 120 and its companion closure be removed. As indicated in FIG. 4 a second closure member 123 is mounted at the upper end of the skirt sleeve 121. The cable 124 is secured to the fixture 125 on dome 126 of closure 120. The cable 124 is in spiral configuration fixed within the seal 127. The other end 128 of the cable extends to an eyelet 129 inside the closure member inside the dome 130 forming part of the upper closure. The dome 130 is secured by the annular seal 131 inside a cylinder 132 the walls of which are substantially thinner than the walls of the skirt sleeve 121. A second cable 133 is secured at one end to the fixture 134 and dome 130. The cable 133 is secured in spiral orientation in the seal 131. The other end 135 of the cable is then available for applying tension to destroy the seal 131. In practice, the spacing between closures 120 and 123 in skirt sleeve 121 may be on the order of 100 feet with closures 120 and 123 installed near opposite ends. The closure 120 would be in the lower end. The closure 123 would close the upper end. By application of tension to the upper end 135 of the cable 133 the upper closure 123 would first be ripped out. Then by means of cable 128 the lower closure 127 would be ripped out. Because of the difference in the internal diameter of the upper cylinder 132 as compared with the internal diameter of the skirt sleeve 121 the lower closure 120 may readily pass the frayed inner surface of the upper seal.

While in FIGS. 1 and 2 it will be apparent that the cable as secured within the seals 16 and 102, respectively, are in a cylindrical configuration, it will be noted that in the seal 127 of FIG. 4 the configuration of the spiral cable within the seal 127 is of a conical configuration with the lower turn closely adjacent the external surface of the dome 126 and the upper turn closely adjacent the inner wall of the skirt sleeve insert. When the conical array is employed it has been found that the forces required to pull the dome 126 out of the pipe are much less than if the seal is ruptured by cable that is arrayed in the cylindrical configuration as in the seal 102 of FIG. 2. In some applications where skirt sleeves are closed by means of the present invention, the seal may be adhered directly to the inner wall of the skirt sleeve and the spiral inlay located in a cylindrical configuration immediately adjacent the inner wall of the skirt sleeve so that when the seal is broken and the closure is removed any remains of the seal on the inner wall of the skirt sleeve will be minimal.

A pile thus previously closed, when driven down into the formations below the lower end of a skirt sleeve will cause minimum disturbance of the earth material contacting both the outer wall and the inner wall of the pile. This permits anchoring of a given structure with a pile of less length than would be necessary if the earth materials contacting the inner wall were to be substantially disturbed as the pile is driven in place by reason of a relatively thick remnant of the seal 127 in the pile.

Figure 5:
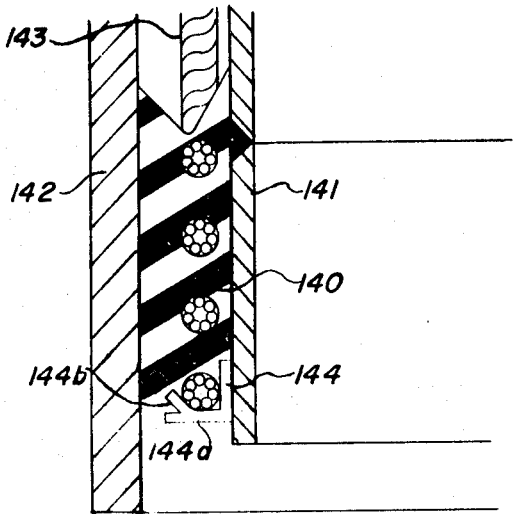
FIG. 5 is an enlarged view of a preferred seal construction.

FIG. 5 illustrates in enlarged sectional view the lower end of a preferred embodiment of seal construction. In this embodiment, the seal 140 is adhered to the outer surface of the body 141 and the inner surface of a cylinder 142. Cable 143 is shown entering the upper end of the seal 140 and as shown comprises four turns. The lower, bottom turn is nested in the upper surface of a premolded annular nest 144. The nest 144 would be made out of material such as polyurethane or rubber and adhered to the outer surface of the body 141 having a cylindrical portion providing for such surface contact and having a radial arm **144*a* that has an upturn portion 144*b* to form the nest. The lower turn of the cable 143 is thus sealed and the cable itself is thus not exposed to the fluid pressures that would be present. It has been found that if the cable is exposed, as it would tend to migrate to the lower end of the seal 140, that hydrostatic pressures would cause leakage through the spiral paths along the wrappings of the cable 143. Thus, the nest 144 prevents this problem as otherwise is present where the nest 144** is not employed.

What is claimed is:

1. A removable closure apparatus for a hollow open-ended tubular member, comprising:

(a) a body spanning the major portion of the cross sectional area of said member; and (b) an annular seal of rupturable material securing said body to the inner wall of said tubular member having a tensile bearing multi turn inlay therein coaxial with said member and helically encircling said body and coupled to said body for forming an annular trough in said material which progressively deepens as said inlay is drawn from said seal to destroy the structural integrity of said annular member to permit removal of said plug means from within said tubular member.

2. A removable closure apparatus for open-ended hollow tubular members, comprising:

(a) plug means disposed inside said tubular member;

(b) a seal formed around said plug means between the inner surface of said tubular member and the outer surface of said plug means comprising a bonded rubber cylinder; and (c) means including a cable spiraled around said plug means and embedded within said cylinder with one end thereof extending out of said seal for manipulation from the upper end of the columnar member, said cable unspiraling from around said plug means and tearing said seal upon the application of said force to said end for destroying the structural integrity of said seal to permit removal of said plug means from within said tubular member.

3. The closure apparatus of claim 2 wherein the other end of said cable is affixed to said plug means and is operative to pull said plug means out of said tubular member after tearing said cylinder.

4. The closure apparatus of claim 1 wherein said body means comprises:

(a) a head portion of a dome-shaped configuration, and (b) a skirt portion comprising a tubular member closed at the upper end by said head portion and open-ended at the lower end.

5. A removable closure for open-ended tubular members used in offshore platform structures, comprising:

(a) plug means concentrically positioned within said tubular member defining a substantially uniform annulus between the inner surface of said tubular member and the outer surface of said plug means;

(b) a seal formed in the annulus between the inner surface of said tubular member and the outer surface of said plug means by bonding a rubber cylinder to each of said surfaces, said seal extending over less than the entire length of said tubular member; and (c) a cable spiraled several times around said plug means and embedded within said cylinder with a first end being affixed to the top of said plug means and the second end extending out of said seal for manipulation from the upper end of said tubular member, said cable unspiraling upon the application to said second end of a force sufficient to tear said seal and permit removal of said plug means out the upper end of the member.

6. The apparatus of claim 5 wherein said plug means comprises:

(a) a dome-shaped head portion having a loop secured thereto in alignment with the center line axis of said plug means; and (b) a skirt portion comprised of a hollow tubular cylinder attached to said head portion about the periphery of its upper end, said cylinder being open at its lower end.

* * * * *